United States Patent [19]

Murphy

[11] 3,987,635

[45] Oct. 26, 1976

[54] METHOD OF REINFORCING ROCK STRATA

[75] Inventor: John Michael Murphy, Mansfield, England

[73] Assignee: Exchem Holdings Limited, London, England

[22] Filed: Apr. 1, 1976

[21] Appl. No.: 672,624

[30] Foreign Application Priority Data

Apr. 1, 1975 United Kingdom ..... 13356/75

[52] U.S. Cl. ..... 61/45 B; 52/698

[51] Int. Cl.[2] ..... E21D 21/00; E21D 20/02

[58] Field of Search ..... 61/45 B, 39, 35; 85/69, 85/86, 87, 88; 52/698, 704

[56] References Cited

UNITED STATES PATENTS

| | | | |
|---|---|---|---|
| 3,430,449 | 3/1969 | Novotny et al. | 61/45 B |
| 3,695,045 | 10/1972 | Williams | 61/45 B |
| 3,698,196 | 10/1972 | Jankowski et al. | 61/45 B |
| 3,805,533 | 4/1974 | Askey et al. | 61/45 B |
| 3,849,992 | 11/1974 | Murphy | 61/45 B |
| 3,877,235 | 4/1975 | Hill | 61/45 B |

FOREIGN PATENTS OR APPLICATIONS

| | | | |
|---|---|---|---|
| 1,178,815 | 10/1964 | Germany | 61/45 B |

*Primary Examiner*—Dennis L. Taylor
*Attorney, Agent, or Firm*—Browdy and Neimark

[57] ABSTRACT

A method of reinforcing rock strata, such as that around underground openings in mines, is effected by using a first wooden reinforcing dowel to drive a second wooden reinforcing dowel into contact with resin capsules located at the inner end of a borehole. The first dowel is then removed from the borehole while additional resin capsules are positioned in the borehole and a further wooden dowel is then inserted into the borehole so as to become embedded in mixed resinous composition from the additional capsules. In this manner it is possible to reinforce the strata to a considerable depth, for example upwards of 16 feet, without the danger of metallic drill rods becoming jammed in the borehole and thereby obstructing subsequent cutting of the reinforced strata by mining machinery.

7 Claims, 3 Drawing Figures

METHOD OF REINFORCING ROCK STRATA

This invention relates to a method of reinforcing and stabilizing rock strata principally but not exclusively around underground openings.

It is well known to use tensioned or fully bonded steel rock bolts for strata reinforcement and more recently the practice of using wood or glass fibre reinforcing dowels, fully resin bonded into the strata has been adopted. This later development is of particular value in situations where reinforcement of only a temporary nature is required prior to the reinforced rock being subsequently mined. The wood or glass fibre reinforcing dowel may be cut easily and safely by modern mining machinery, whereas a steel rockbolt cannot be cut and would seriously obstruct the rock cutting and extraction procedures. Consequently the use of non-metallic reinforcing elements has enabled reinforcement to be placed in the most effective position, which is frequently wholly or partially within the cutting path of the mining equipment.

Methods of injecting resinous or other bonding agents around the reinforcing dowels are well known and used to some extent but the preferred method of installation makes use of pre-packaged capsules containing a resinous composition. Typically for installation of a 6 feet wooden reinforcing dowel, a borehole is drilled in the rock strata, two or three resin capsules are placed in the borehole and the reinforcing dowel is then inserted while rotating. The action of dowel insertion ruptures the resin capsules and mixes the contents thereof which then set rapidly to bond the dowel firmly into the borehole.

In practice the maximum dowel length which can be inserted by this technique is limited to about 8 feet because of the difficulties of handling in confined spaces and also the physical effort required to push the dowel through the resin capsules in the borehole. In some circumstances the desired level of strata reinforcement cannot be achieved with dowels of this length and it is preferred to reinforce up to 16 feet depth in the strata. A technique, known as "tandem dowelling", has recently been employed in the United Kingdom and in South Africa to enable reinforcement to be installed to this greater depth. This technique involves the installation of two reinforcing dowels in two stages. In the first stage, after a plurality of resin capsules have been positioned at the inner end of the borehole, a reinforcing dowel is inserted and rotated by means of a metallic adaptor attached to a standard metallic drill rod. The drill rod and adaptor are withdrawn after the installation of the inner dowel and prior to placing further resin capsules in the borehole for bonding of the second reinforcing dowel. In the second stage, the second dowel is inserted and rotated by means of an adaptor directly driven from a drill chuck. While this technique works well generally, it has been found that occasionally the drill rod and adaptor become jammed in the borehole and thereby remain as a metallic obstruction to the subsequent cutting of the reinforced strata.

It is an object of the present invention to provide a modified tandem dowelling system which will obviate the risk of metallic drill apparatus becoming jammed in the borehole and thereby obstructing the subsequent cutting of the reinforced strata.

According to the present invention, there is provided a method of reinforcing rock strata, which comprises drilling a borehole into the rock strata, positioning in the inner end portion of the borehole one or more capsules containing a resinous composition, positioning in the borehole a first wooden reinforcing dowel which is detachably engaged by non-metallic means with a second wooden reinforcing dowel positioned nearer the outer end portion of the borehole, causing the second reinforcing dowel to rotate and thereby consequentially causing the first reinforcing dowel to rotate within the borehole whilst in contact with the resin capsule(s) until it has reached the inner end portion of the borehole, discontinuing rotation of the second reinforcing dowel and withdrawing it from the borehole so as to leave the first reinforcing dowel embedded in mixed resinous composition in the inner end portion of the borehole, positioning one or more further resin capsules in the outer end portion of the borehole, and thereafter inserting into the borehole with rotation a wooden reinforcing dowel so as to cause the dowel to become embedded in mixed resinous composition in the outer end portion of the borehole.

The first and second wooden reinforcing dowels may be detachably engaged prior to insertion into the borehole, but normally the first dowel will be inserted into the borehole and the second dowel is then detachably engaged with the first dowel within the borehole.

The non-metallic means by which the two dowels are detachably engaged may be a plastics sleeve which fits over the adjacent ends of the dowels, which are preferably chamfered. Alternatively the non-metallic means may be a stout plastics pin which is housed in corresponding recesses formed in the adjacent ends of the dowels. The pin and recesses therefor may be of any desired cross-section, for example circular or square. Suitable materials from which the sleeve or pin may be produced include thermoplastic plastics materials such as polyethylene, polypropylene, or polyvinylchloride, glass fibre-reinforced plastics such as polyester or epoxy laminates, and paper based laminates of phenol-formaldehyde or urea-formaldehyde resins. Advantageously the non-metallic means is formed from high density polyethylene.

The method of the invention is advantageously carried out using resin capsules in which the active constituents are packaged together in a single cartridge, such as that described in our British patent specification No. 1,127,913. These are commercially available in the United Kingdom under the registered Trade Mark "Selfix".

For a better understanding of the invention and to show how the same may be carried into effect, reference will now be made by way of example to the accompanying drawing in which.

Figure 1:
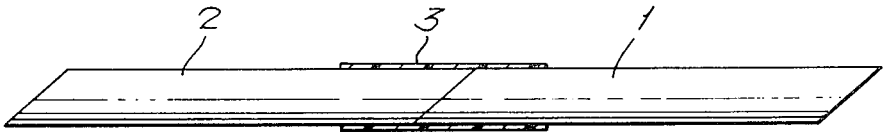
FIG. 1 is a longitudinal cross-section through two detachably engaged wooden dowels assembled for use in the method of the invention.

Referring to FIG. 1 of the accompanying drawing a wooden reinforcing dowel 1 which is chamfered at both ends is disconnectably engaged with a similar dowel 2 by means of a short length of substantially rigid plastics tubing 3. In use rotation of the dowel 2 (i.e. the driving dowel) by means of a drill is transmitted to the dowel 1 which is positioned towards the inner end of a borehole (not shown). After the dowel 1 has become fixed in the borehole by means of the resinous composition originally contained in capsules positioned at the inner end of the borehole, the driving dowel 2 is pulled free from the plastics tubing 3 which remains in the borehole and can subsequently be readily cut by mining machinery if necessary. In the event that for some reason the driving dowel 2 becomes jammed in the borehole, this does not give rise to subsequent difficulty in mining operations, since if necessary the wooden dowel 2 can be readily cut by mining machinery.

Figure 2:
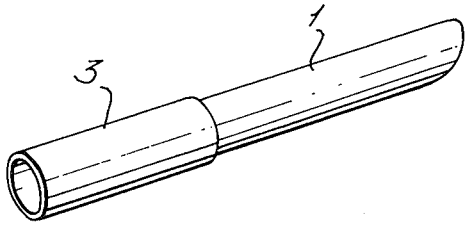
FIG. 2 is an isometric view of a wooden dowel having non-metallic engaging means attached to one end thereof.

FIG. 2 of the drawing shows the wooden reinforcing dowel 1 having the plastics tubing 3 force fitted on to one end thereof prior to the dowel 2 (as shown in FIG. 1) being force fitted into the open end of the tubing 3 to form the assembly shown in FIG. 1. The adjacent chamfered ends of the two dowels positioned within the tubing 3 enable rotational movement imparted to dowel 2 to be transmitted to dowel 1.

Figure 3:
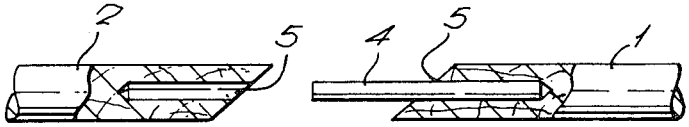
FIG. 3 is a longitudinal cross-section through two wooden dowels showing another means by which they can be detachably engaged.

Referring now to FIG. 3 of the drawing, there is illustrated therein another means by which two wooden reinforcing dowels can be disconnectably engaged for use in the method of the invention. A stout plastics pin 4 of substantially circular cross-section is bonded into a socket 5 of substantially circular cross-section formed in the chamfered end of a dowel 1 and is then likewise inserted into a like socket 5 formed in the chamfered end of a like dowel 2. Thus rotation of dowel 2 causes the dowel 1 to rotate.

The following Example further illustrates the method of the invention.

EXAMPLE

Forward reinforcement of the face and immediate roof strata in a fault area on a longwall coal face was carried out using a 12 foot tandem dowelling reinforcement system in accordance with the invention. The boreholes were spaced 3 feet apart and each borehole was dowelled by the following method.

A borehole 43mm. in diameter was drilled with standard coal drilling equipment to a depth of 12 feet. Three capsules, each 40mm. in diameter and 330 mm. long, containing a polyester resin-based mastic and catalyst system, were placed at the inner end of the borehole. A chamfered keruing dowel 36 mm. in diameter and 6 feet long was fitted with a plastics sleeve as illustrated in FIG. 2. The sleeve had an internal diameter of 36mm., an external diameter of 39mm. and a length of 120mm. and was cut from extruded high density polyethylene tubing. The sleeve was secured to the dowel with two 12mm. copper staples. The dowel was inserted into the borehole, the end with the fitted sleeve being outermost. A second chamfered keruing dowel was inserted into the sleeve so that the chamfered ends of the two dowels were engaged. The assembly thus formed was pushed further into the borehole until the resin capsules were contacted and was then rotated using a standard coal drill with suitable adaptor. While rotating, the assembly was pushed fully home to the back of the borehole. Rotation was then discontinued and the outer dowel removed from the borehole. The inner dowel, complete with fitted sleeve, remained embedded in the mixed resin in the innermost part of the borehole.

Five resin capsules were then inserted into the outer part of the borehole and a 36mm. diameter keruing dowel, 6 feet in length, was inserted with rotation to completely fill the borehole with bonded dowel reinforcement.

The fault area of the face was substantially reinforced by the above method so that subsequent mining of the coal through potentially dangerous conditions was carried out safely and quickly.

I claim:

1. A method of reinforcing rock strata, which comprises the steps of (a) drilling a borehole into the rock strata, (b) positioning in the inner end portion of the borehole one or more capsules containing a resinous composition, (c) positioning in the borehole a first wooden reinforcing dowel which is detachably engaged by non-metallic means with a second wooden reinforcing dowel positioned nearer the outer end portion of the borehole, (d) causing the second reinforcing dowel to rotate and thereby consequently causing the first reinforcing dowel to rotate within the borehole whilst in contact with the resin capsule(s) until it has reached the inner end portion of the borehole, (e) discontinuing rotation of the second reinforcing dowel and withdrawing it from the borehole so as to leave the first reinforcing dowel embedded in mixed resinous composition in the inner end portion of the borehole, (f) positioning one or more further resin capsules in the outer end portion of the borehole, and (g) thereafter inserting into the borehole with rotation a wooden reinforcing dowel so as to cause the dowel to become embedded in mixed resinous composition in the outer portion of the borehole.

2. A method according to claim 1, wherein in step (c) the first and second wooden reinforcing dowels have adjacent ends which are chamfered.

3. A method according to claim 1, wherein in step (c) the first dowel is inserted into the borehole and the second dowel is then inserted into the borehole and detachably engaged by said non-metallic means with the first dowel within the borehole.

4. A method according to claim 1, wherein for the purposes of step (c) the first and second dowels are detachably engaged to form a dowel assembly prior to being inserted into the borehole.

5. A method according to claim 1, wherein said non-metallic means for detachably engaging the first and second dowels is a plastics sleeve.

6. A method according to claim 5, wherein the sleeve is formed from high density polyethylene.

7. A method according to claim 3, wherein the non-metallic means is a plastics sleeve which is fitted to that end of the first dowel which is detachably engaged with the second dowel.

* * * * *